US012319456B2

(12) United States Patent
Casadei

(10) Patent No.: US 12,319,456 B2
(45) Date of Patent: Jun. 3, 2025

(54) FILM GRIPPING AND RELEASING DEVICE FOR PALLET WRAPPING MACHINES AND RELATED METHOD OF OPERATION

(71) Applicant: C&C GROUP S.R.L., Cesena (IT)

(72) Inventor: Claudio Casadei, Cesena (IT)

(73) Assignee: C&C GROUP S.R.L., Cesena (IT)

( * ) Notice: Subject to any disclaimer, the term of this patent is extended or adjusted under 35 U.S.C. 154(b) by 0 days.

(21) Appl. No.: 18/315,699

(22) Filed: May 11, 2023

(65) Prior Publication Data

US 2023/0365285 A1 Nov. 16, 2023

(30) Foreign Application Priority Data

May 16, 2022 (IT) ..... 102022000010052

(51) Int. Cl.
*B65B 11/04* (2006.01)
*B65B 41/14* (2006.01)
*B65B 61/06* (2006.01)

(52) U.S. Cl.
CPC ..... *B65B 41/14* (2013.01); *B65B 11/045* (2013.01); *B65B 61/06* (2013.01)

(58) Field of Classification Search
CPC ..... B65B 11/045; B65B 41/14; B65B 61/06
See application file for complete search history.

(56) References Cited

U.S. PATENT DOCUMENTS 6,185,900 B1 * 2/2001 Martin ..... B65B 11/045 53/118
6,269,610 B1 * 8/2001 Lancaster, III ..... B65B 11/045 53/399
6,449,922 B2 * 9/2002 Lancaster, III ..... B65B 11/045 53/399
6,848,237 B2 * 2/2005 Lancaster, III ..... B65B 11/045 53/399
7,047,707 B2 * 5/2006 Lancaster, III ..... B65B 11/045 53/399
7,089,713 B2 * 8/2006 Lancaster, III ..... B65B 11/045 53/399

(Continued)

OTHER PUBLICATIONS

European Search Report dated Oct. 30, 2023 from counterpart European App No. 23020218.

(Continued)

*Primary Examiner* — Thomas M Wittenschlaeger
*Assistant Examiner* — David G Shutty
(74) *Attorney, Agent, or Firm* — SHUTTLEWORTH & INGERSOLL, PLC; Timothy J. Klima

(57) ABSTRACT

A film gripping and releasing device for pallet wrapping machines of the type with a turntable and a fixed frame, comprises a gripper and movement means for the gripper on board the table, and a movable contact element constrained to the frame. The movable contact element can go from a retracted home position to an operating position projecting from the frame, and vice versa. When the contact element projects from the frame interacts with the movement means for the gripper in such a way as to shift the gripper along a guide, on which are arranged opening means and closing means for the gripper which are suitable for making the gripper go from a closed position in which it clamps the film to an open position in which it releases the film, and vice versa.

12 Claims, 9 Drawing Sheets

(56) References Cited

U.S. PATENT DOCUMENTS

| | | | | |
|---|---|---|---|---|
| 8,997,439 | B2 * | 4/2015 | Ciou | B65B 11/045 53/389.2 |
| 9,016,033 | B2 * | 4/2015 | Ciou | B26D 7/02 225/101 |
| 9,511,886 | B2 * | 12/2016 | Liu | B65B 11/045 |
| 9,981,762 | B2 * | 5/2018 | Chalmers | B65D 19/00 |
| 11,242,165 | B2 * | 2/2022 | Basharanov | B65B 41/12 |
| 2013/0312366 | A1 | 11/2013 | Ciou | |

OTHER PUBLICATIONS

Italian Search Report dated Jan. 5, 2023 from counterpart Italian App No. 202200010052.

* cited by examiner

FILM GRIPPING AND RELEASING DEVICE FOR PALLET WRAPPING MACHINES AND RELATED METHOD OF OPERATION

This application claims priority to Italian Patent Application 102022000010052 filed May 16, 2022, the entirety of which is incorporated by reference herein.

The present invention concerns a film gripping and releasing device for pallet wrapping machines and the operating method thereof.

In the field of pallet wrapping machines having a turntable, one of the major criticalities occurs at the end of wrapping of a pallet, when it is necessary to cut the plastic film and hold the free edge to start wrapping the next pallet.

For some decades this operation has no longer been performed manually, but with the aid of automatic or semi-automatic machines: both carry out the winding phase autonomously, but in the semi-automatic machines the cutting of the film is performed by an operator, while the automatic machines are provided with a cutting device and a gripper which holds the film until the start of the next cycle, requiring the intervention of an operator only to replace the plastic film reel.

In known automatic machines, the movement of the gripper is operated by a pneumatic device synchronized with the times of the pallet wrapping cycle: generally, in these machines the table has a thickness ranging between 5 and 10 centimeters, so it is quite simple to insert inside the table the cables necessary to bring on board of it the electrical power supply and/or the compressed air necessary for the correct functioning of the gripper.

In the most recent pallet wrapping machines, wherein the thickness of the table is less than 3 centimeters, for example as described in patent EP 2808262 in the name of same applicant, it is however practically impossible to house inside the table itself all the connections necessary for the operation of the device that operates the movement of the gripper.

The aim of this invention is therefore to eliminate the above-mentioned disadvantages.

The invention, characterised as set out in the claims, achieves that aim by mounting on the table a fully mechanical gripper.

The main advantage obtained by means of this invention is basically the fact that a gripper of this type is not conditioned in any way by the size of the table, in particular by its thickness. Furthermore, the invention can be easily mounted also on machines that have already been made and are in operation.

Finally, since pneumatic devices are not used, all the operational problems that often arise when compressed air is used are avoided at the outset.

Further advantages and features of the invention will be more apparent in the detailed description which follows, with reference to the accompanying drawings, which show an example non-limiting embodiment, wherein.

Figure 1:
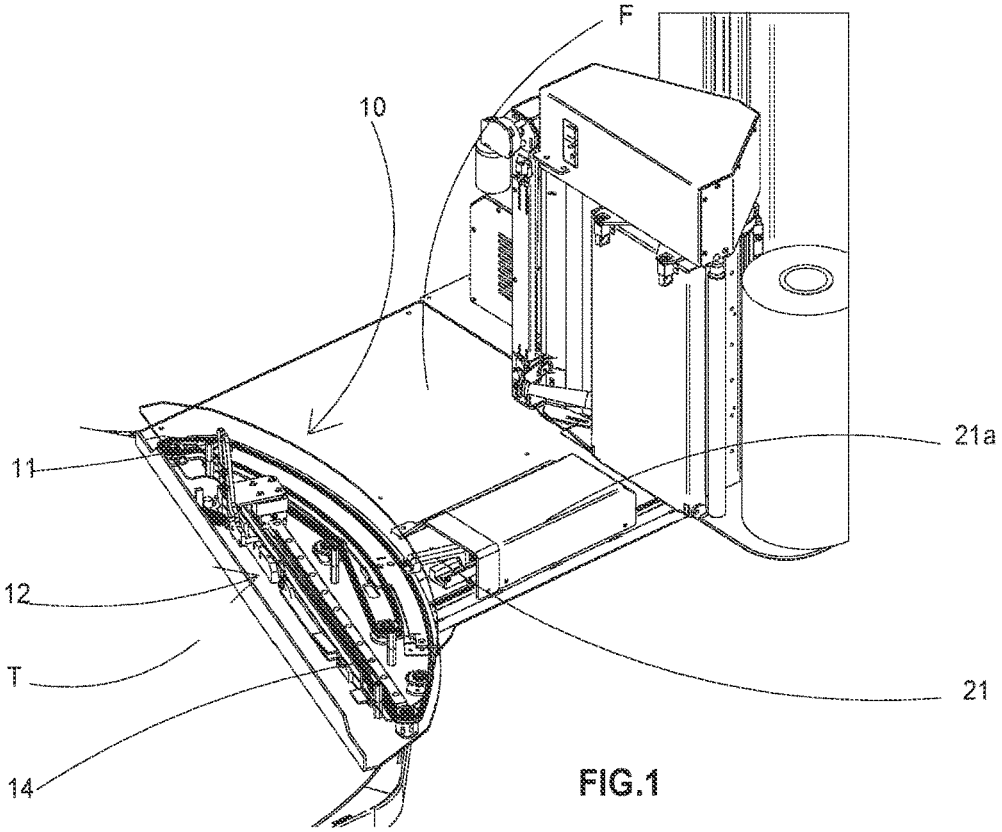
FIG. 1 shows the invention according to a perspective view in a use condition.

As it can be seen from the figures, the invention relates to a film gripping and releasing device for pallet wrapping machines comprising a turntable (T) and a fixed frame (F).

The device (10) comprises a gripper (11) and movement means (12) for the gripper (11) on board the table (T), and a movable contact element (21) constrained to the frame (F). The movable contact element (21) can go from a retracted home position to an operating position projecting from the frame (F), and vice versa; when the movable contact element (21) projects from the frame (F) it interacts with the movement means (12) for the gripper (11), in such a way as to shift the gripper (11) along a guide (14), on which there are opening means (15) and closing means (16) for the gripper (11) suitable for making the gripper (11) go from a closed position in which it clamps the film to an open position in which it releases the film, and vice versa.

In the embodiment shown in the figures, the movement means (12) for the gripper (11) comprise a closed chain (121) provided with a pair of projections (122*a*, 122*b*) fixed to the chain (121), which are alternately intercepted by the movable contact element (21) in operating position, in such a way as to shift the gripper (11) in opposite directions along the guide (14).

Figure 8:
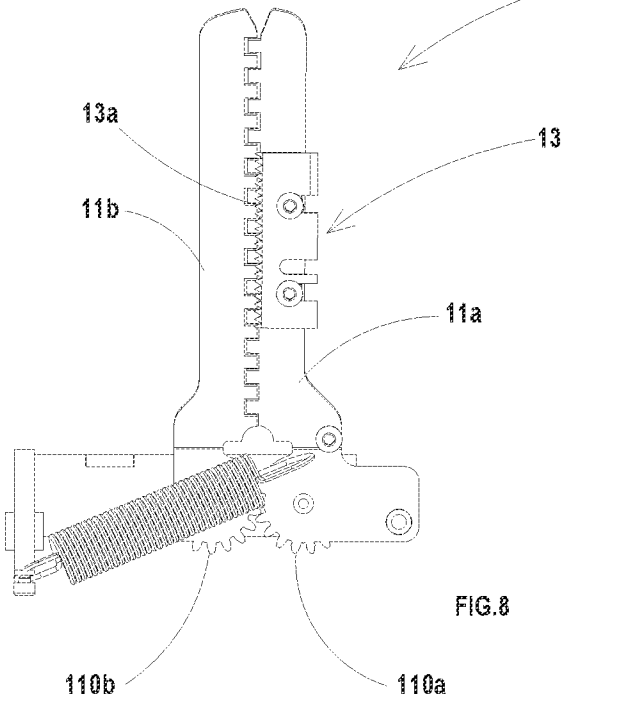
FIG. 8 shows the detail of FIG. 7 according to a side view.
Figure 7:
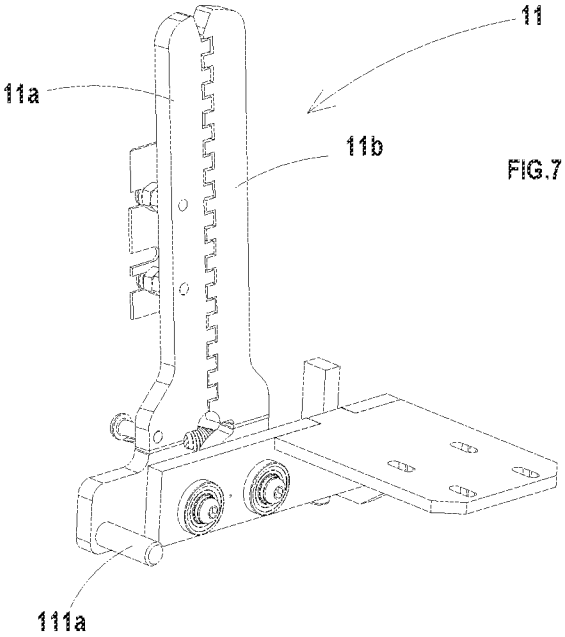
FIG. 7 shows a detail of the invention according to a side perspective view.
Figure 9:
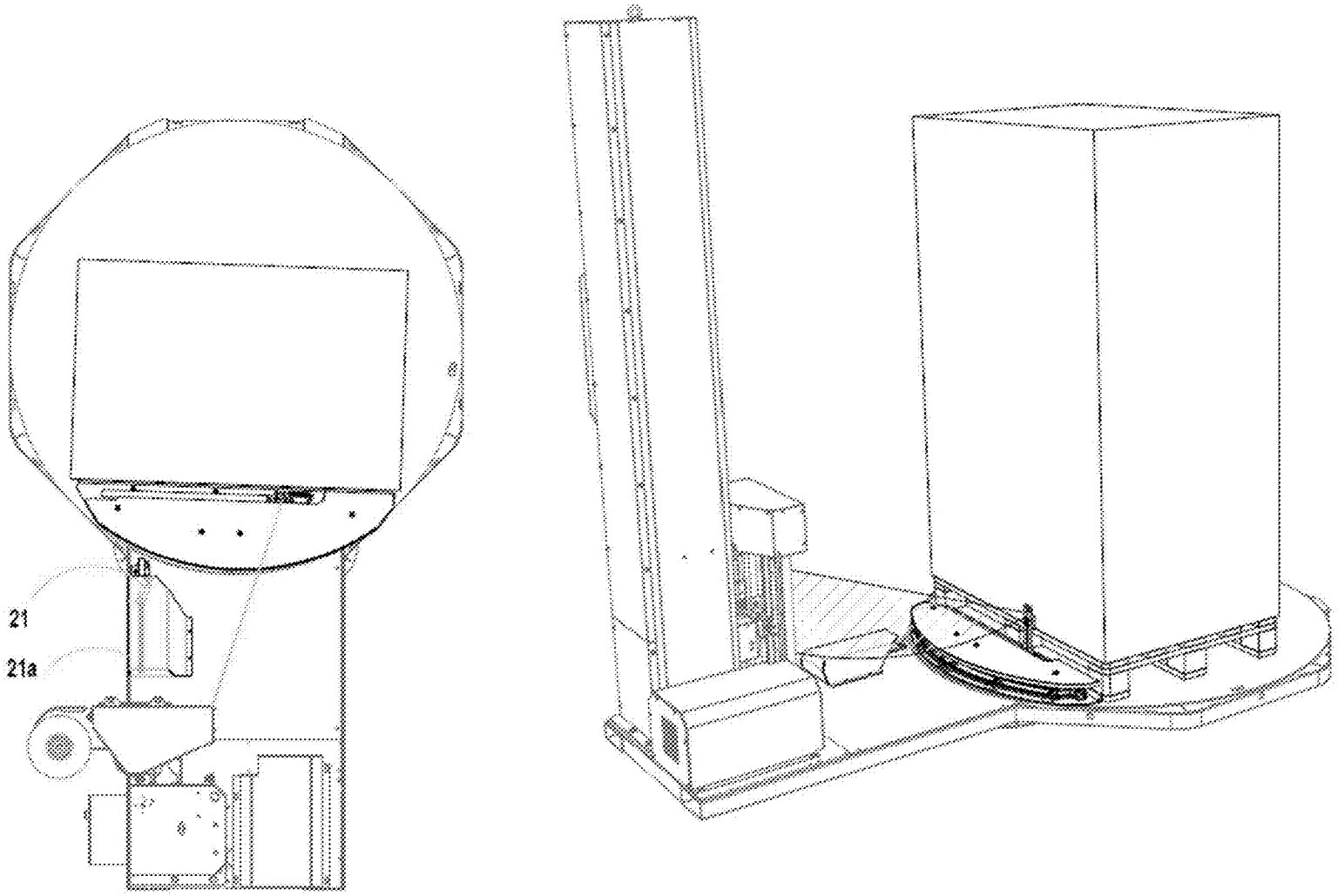
FIG. 9 shows the invention in a first use condition according to a top plan view and to a front perspective view.
Figure 10:
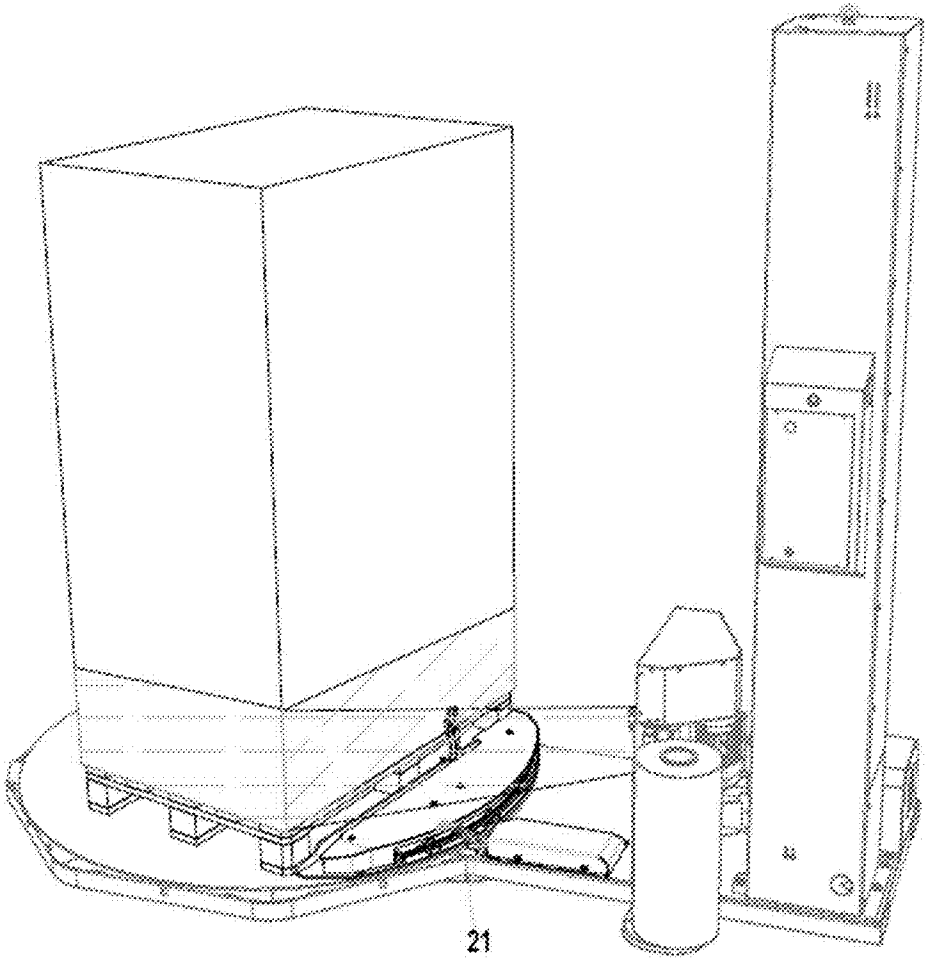
FIG. 10 shows the invention in a second use condition according to a top plan view and to a front perspective view.
Figure 10:
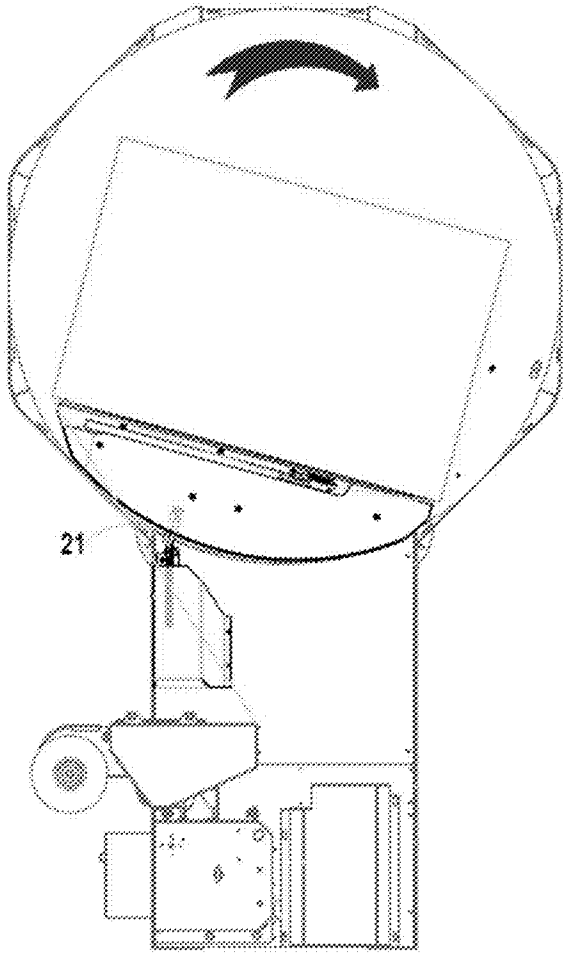
Figure 11:
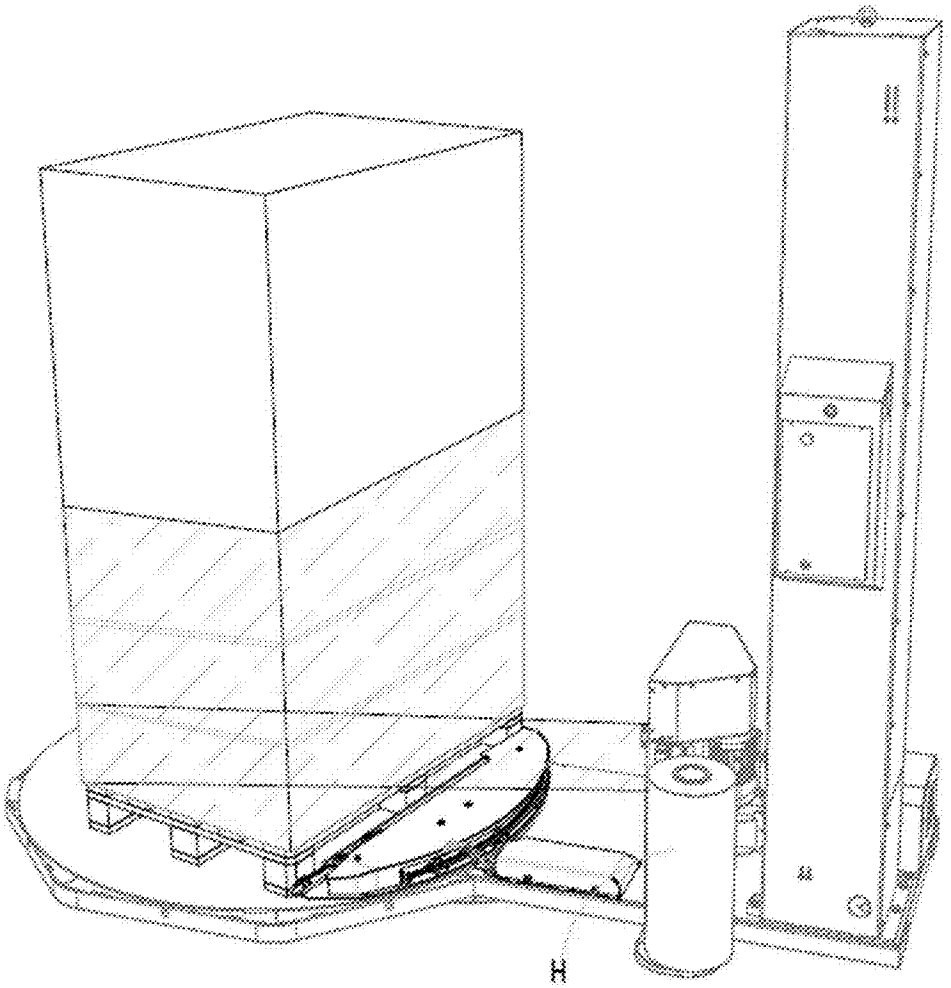
FIG. 11 shows the invention in a third use condition according to a top plan view and to a front perspective view.
Figure 11:
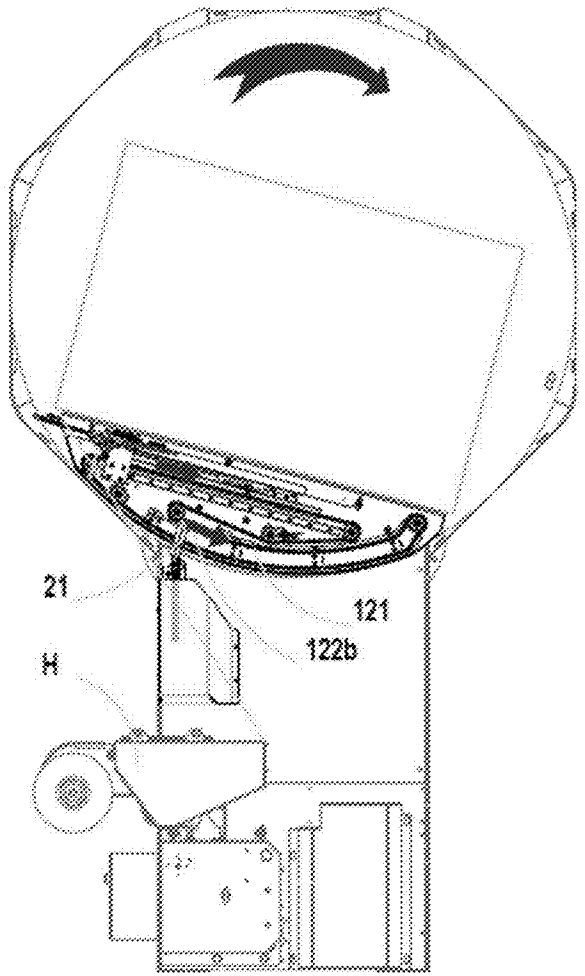
Figure 12:
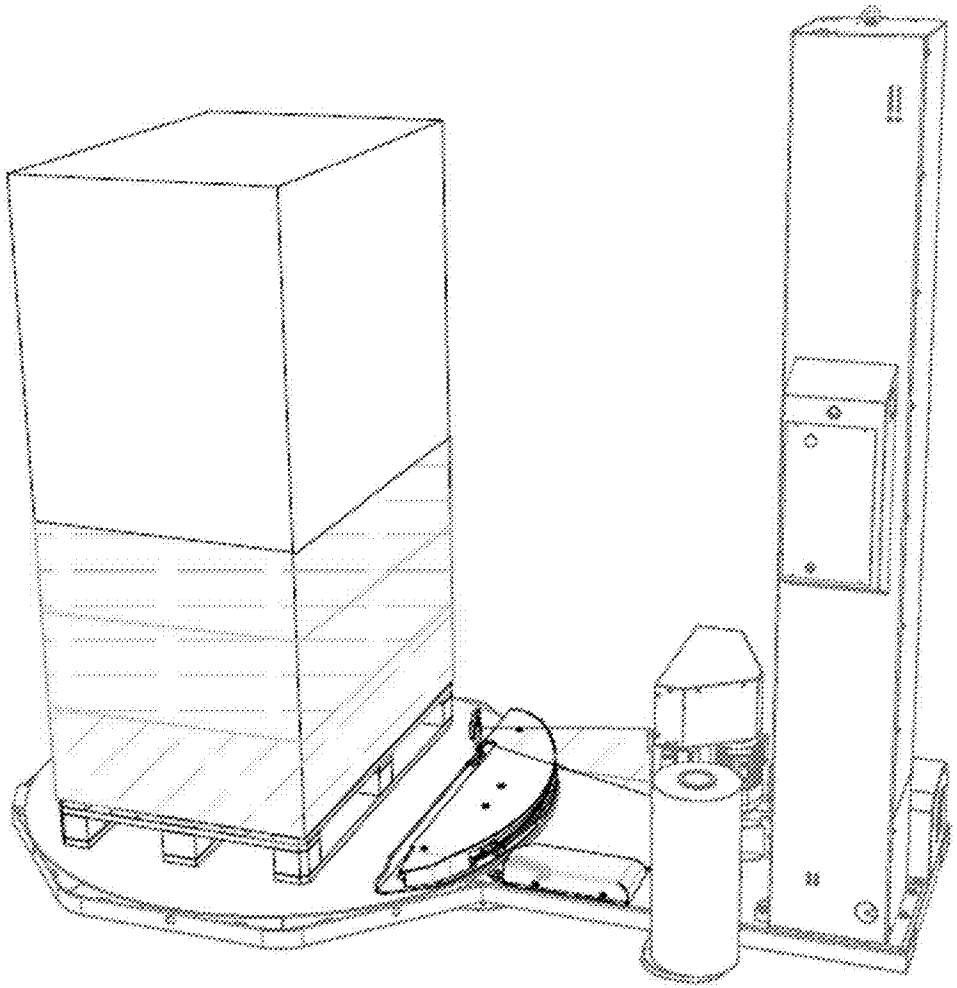
FIG. 12 shows the invention in a fourth use condition according to a top plan view and to a front perspective view.
Figure 12:
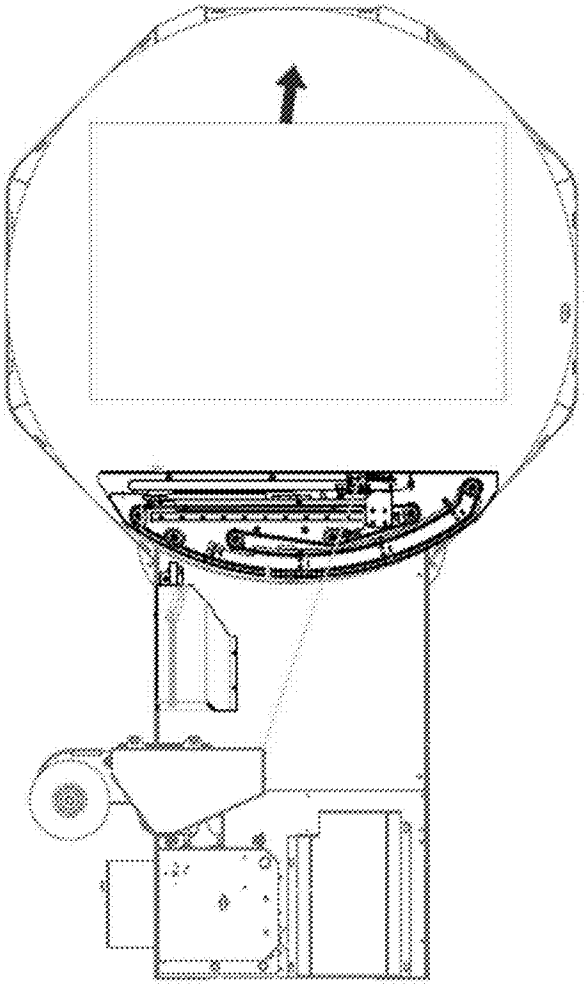

In order to allow its opening and closing, as can be seen in FIGS. 7 and 8, the gripper (11) comprises two half-grippers (11*a*, 11*b*) provided with toothed bases (110*a*, 110*b*) engaged with each other, in such a way as to make the two half-grippers (11*a*, 11*b*) rotate in opposite directions. Furthermore, at least one of the half-grippers (11*a*, 11*b*) is provided with a pin (111*a*) projecting laterally from the gripper.

The opening means (15) for the gripper (11) comprise a first cam (15*a*), suitable for intercepting the pin (111*a*) fixed to a first half-gripper (11*a*) in such a way as to make the half-gripper (11*a*) rotate and cause the gripper (11) to open; similarly, the closing means (16) for the gripper (11) comprise a second cam (16*a*), suitable for intercepting the pin (111*a*) in such a way as to make rotate the half-gripper (11*a*) to which the pin (111*a*) is constrained in the opposite direction and to cause the gripper (11) to close.

After closing the gripper (11), to avoid the intervention of an operator, the device (10) should be equipped with film cutting means (13) which allow the completion of the wrapping in progress and the start of the one of the next pallet. Although it is not necessary for the cutting means (13) to be fixed to the gripper (11), in the solution shown in the figures they consist of a blade (13*a*) fixed to one side of a half-gripper (11*a*; 11*b*) facing the pallet.

Figure 2:
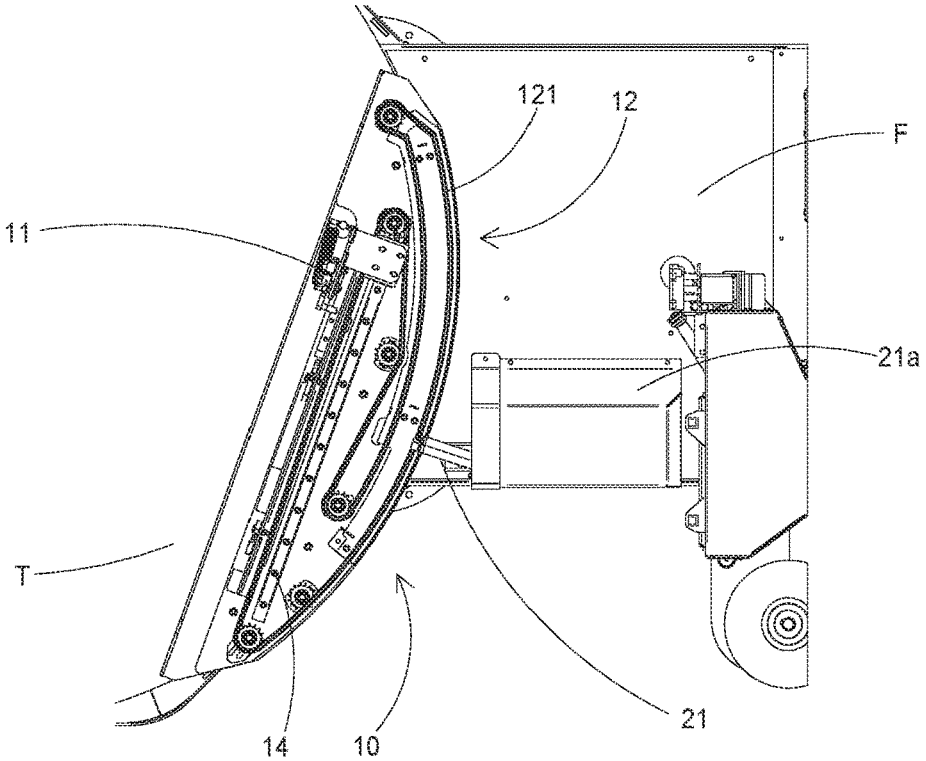
FIG. 2 shows the invention according to a top plan view in the condition shown in FIG. 1.
Figure 3:
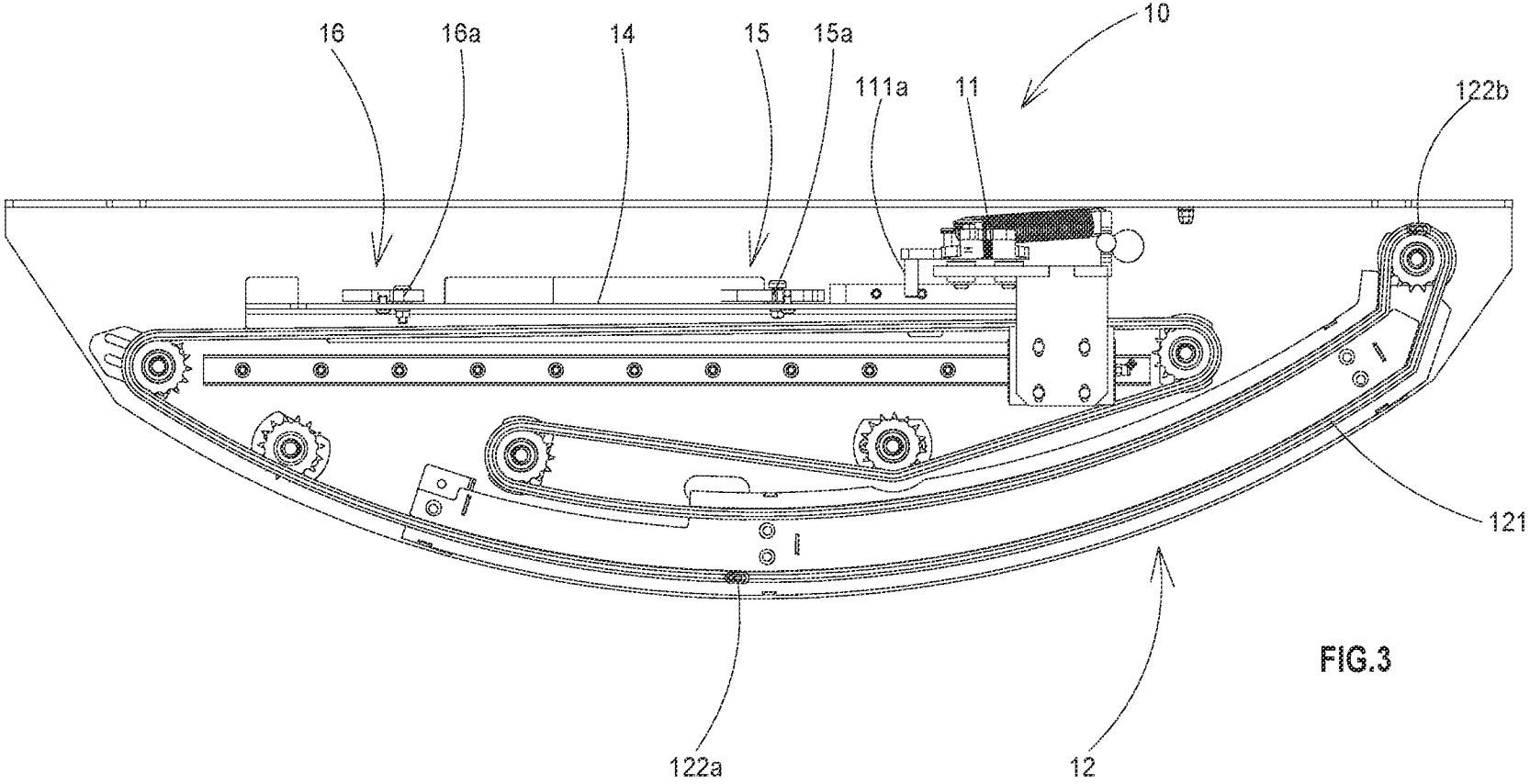
FIG. 3 shows the invention according to a top plan view.
Figure 5:
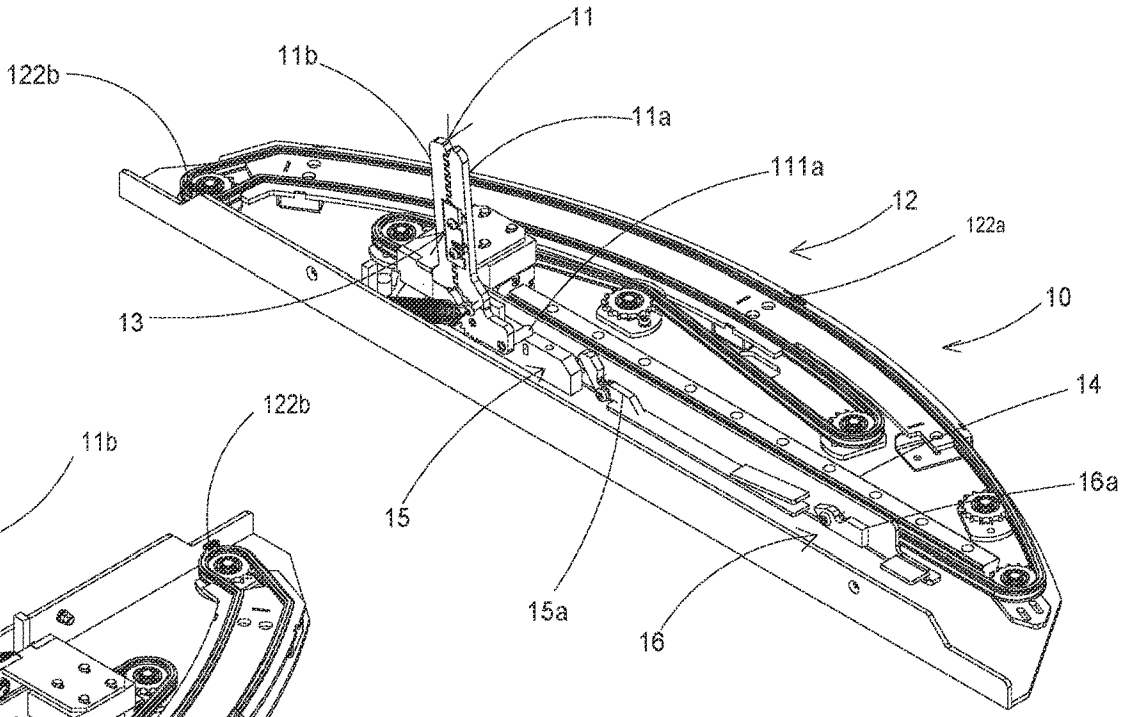
FIG. 5 shows the invention according to a rear perspective view.
Figure 4:
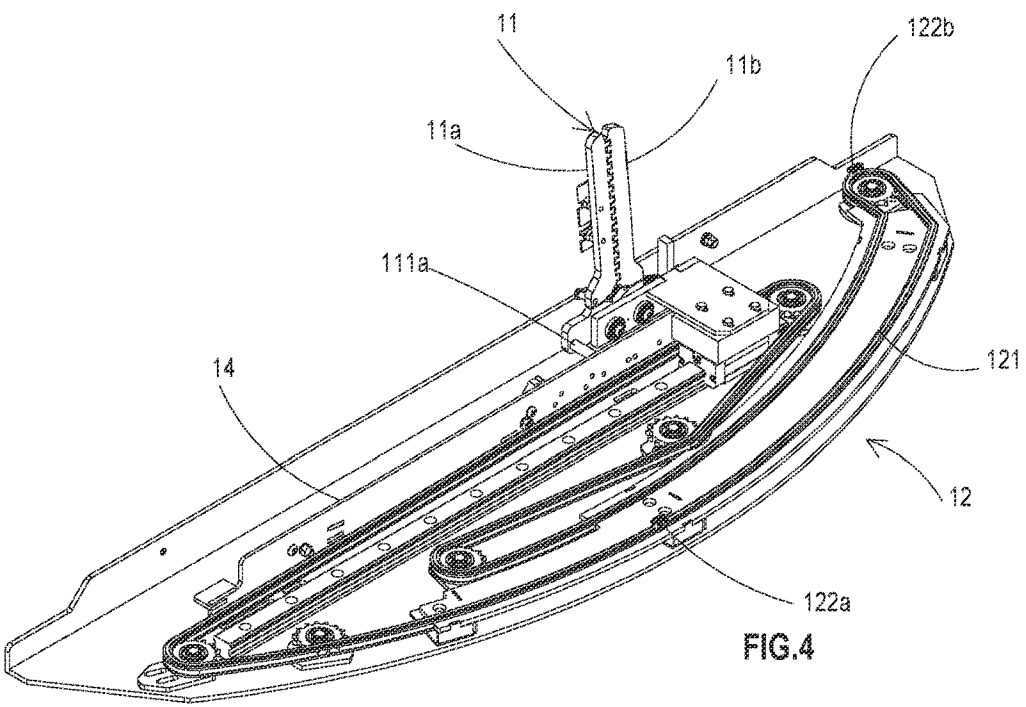
FIG. 4 shows the invention according to a front perspective view.
Figure 6:
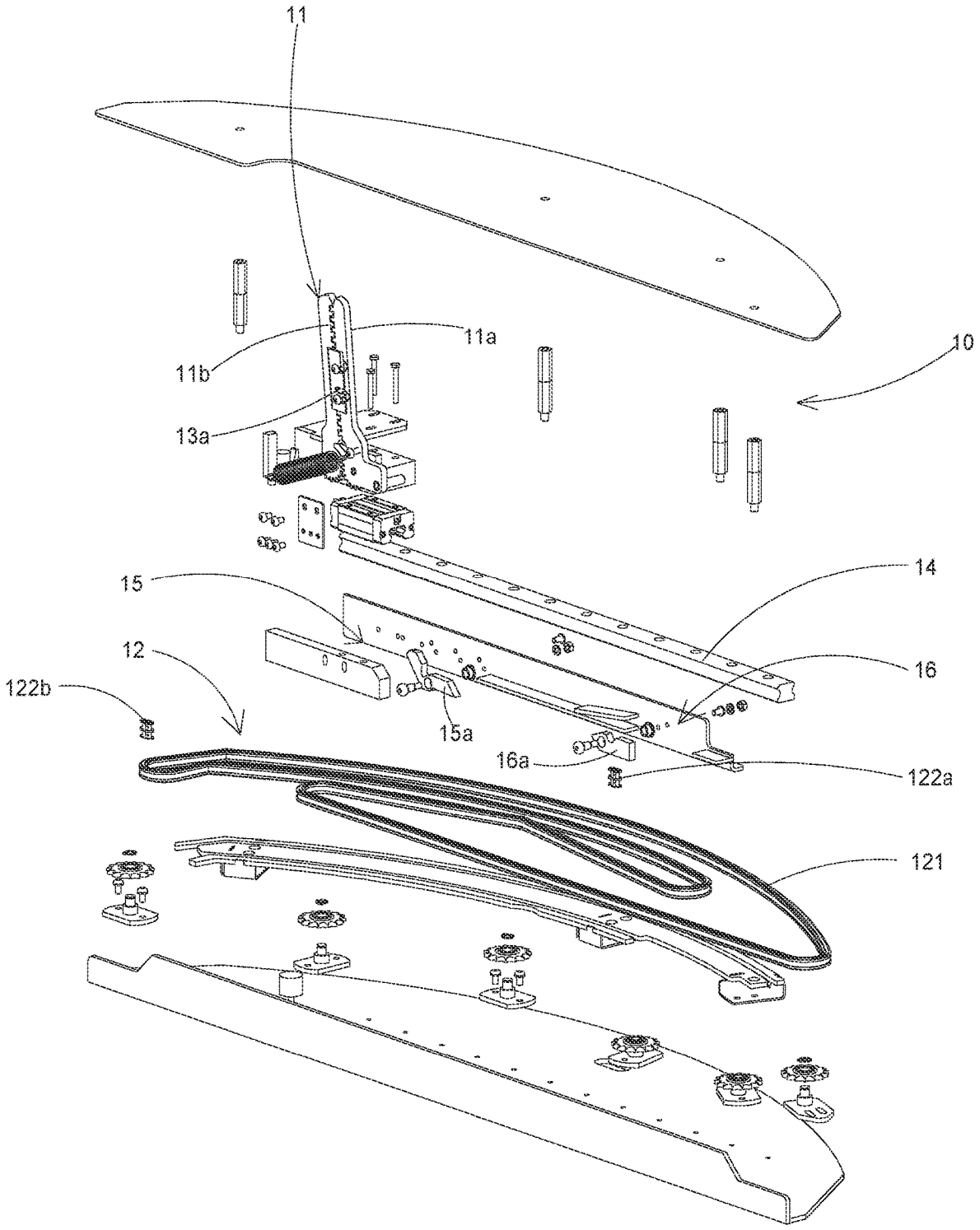
FIG. 6 shows the invention according to an exploded view.

The operating method of the film gripping and releasing device (10) above-described therefore comprises the following steps: initially, and for about a couple of rotations of the rotating table (T), the film is clamped by the gripper (11) while the film is wrapped around the pallet, also covering the gripper (11) to ensure that the wrapping begins correctly; then, the pallet makes a first stop when the device (10) is in front of the fixed frame (F). At this time, as it can be seen in FIGS. 1 and 2, the movable contact element (21) comes out of a seat (21*a*) on the frame (F) in such a way as to intercept the first projection (122*a*) fixed to the chain (121), holding the first projection (122*a*) blocked while the table (T) resumes its rotation; blocking the projection (122*a*) causes the chain (121) to slide in the opposite direction to that of rotation, and the consequent dragging of the gripper (11) along the guide (14) in such a way that the gripper (11) opens and releases the film. This occurs as a result of the fact that the gripper (11), fixed to the chain (121), on its path along the guide (14) comes across the first cam (15*a*) that intercepts the pin (111*a*) fixed to the first half-gripper (11*a*), causing its rotation, and the consequent opening of the gripper (11) which in this way releases the film.

Due to the circular shape of the table (T), after about one eighth of a turn, the contact element (21) no longer interferes with the first projection (122*a*) when the gripper (11) in the open position has reached its end stop along the guide (14); the movable contact element (21) retracts into its seat (21*a*) before the completion of the first rotation of the table (T) and the pallet wrapping continues until, once the wrapping operation is complete, the pallet stops again in front of the fixed frame (F). The movable contact element (21) comes out again from its seat (21*a*) and intercepts the second projection (122*b*), positioned on a branch of the chain (121) opposite to the one on which it is positioned the first projection (121*a*), holding the second projection (122*b*) blocked during the table (T) restart. Therefore, the sliding of the chain (121) in the opposite direction to that of rotation causes the gripper (11) to be dragged backwards along the guide (14) in such a way that the gripper (11) closes and again clamps the film, cutting the film at the pallet side by means of the blade (13*a*) and holding the film from the frame (F) side to start the wrapping of the next pallet. The closing of the gripper (11) is caused by the fact that, at the beginning of its backward stroke along the guide (14), the pin (111*a*) is intercepted by the second cam (16*a*) which causes a rotation in the opposite direction with respect to the previous one of the first half-gripper (11*a*) and the consequent closing of the gripper (11).

The invention claimed is:

1. A film gripping and releasing device for pallet wrapping machines which comprise a turntable and a fixed frame, the film gripping and releasing device comprising:

a gripper and gripper movement mechanism for the gripper on board the turntable, a movable contact element constrained to the frame, the movable contact element being suitable for going from a retracted home position to an operating position projecting from the frame, in which the movable contact element interacts with the gripper movement mechanism, and vice versa, to shift the gripper along a guide, an opening mechanism and closing mechanism for the gripper on the guide which are suitable for making the gripper go from a closed position in which the gripper clamps a film to an open position in which the gripper releases the film, and vice versa, wherein the gripper movement mechanism comprises a closed chain with a pair of projections to the chain which are suitable for being alternately intercepted by the movable contact element in the operating position, to shift the gripper in opposite directions.

2. The device according to claim 1, wherein the gripper comprises two half-grippers provided with toothed bases engaged with each other, to make the two half-grippers rotate in opposite directions.

3. The device according to claim 2, wherein the opening mechanism for the gripper comprises a first cam, suitable for intercepting a pin fixed to a first half-gripper of the two half-grippers to make the first half-gripper rotate and cause the gripper to open.

4. The device according to claim 3, wherein the closing mechanism for the gripper comprises a second cam, suitable for intercepting the pin to make the first half-gripper rotate and cause the gripper to close.

5. The device according to claim 1, and further comprising a film cutting mechanism.

6. The device according to claim 5, wherein the film cutting mechanism comprises a blade fixed to a half-gripper of the gripper.

7. An operating method of a film gripping and releasing device for pallet wrapping machines, the operating method comprising:

providing:

a film gripping and releasing device for pallet wrapping machines which comprise a turntable and a fixed frame, the film gripping and releasing device comprising:

a gripper and gripper movement mechanism for the gripper on board the turntable, a movable contact element constrained to the frame, the movable contact element being suitable for going from a retracted home position to an operating position projecting from the frame, in which the movable contact element interacts with the gripper movement mechanism, and vice versa, to shift the gripper along a guide, an opening mechanism and closing mechanism for the gripper on the guide which are suitable for making the gripper go from a closed position in which the gripper clamps a film to an open position in which the gripper releases the film, and vice versa, wherein the gripper movement mechanism comprises a closed chain with a pair of projections to the chain which are suitable for being alternately intercepted by the movable contact element in the operating position, to shift the gripper in opposite directions, clamping the film by the gripper during an initial wrapping step;

when a pallet makes a first stop, extracting the movable contact element such that the movable contact element intercepts a first projection of the pair of projections, holding the first projection blocked during a start of turntable rotation;

sliding the chain in an opposite direction to that of rotation, and dragging the gripper along the guide such that the gripper opens and releases the film;

retracting the movable contact element before completion of a first revolution of the table;

when the pallet makes a second stop, again extracting the movable contact element such that the movable contact element intercepts a second projection of the pair of projections, holding the second projection blocked during a turntable restart;

sliding the chain in the opposite direction to that of rotation, and dragging the gripper backwards along the guide such that the gripper closes and again clamps the film for wrapping a next pallet.

8. The method according to claim 7, and further comprising a final step of cutting the film, in which the film is freed on a pallet side and retained on a frame side for a next wrapping operation.

9. A film gripping and releasing device for pallet wrapping machines which comprise a turntable and a fixed frame, the film gripping and releasing device comprising:

a gripper and gripper movement mechanism for the gripper on board the turntable, a movable contact element constrained to the frame, the movable contact element being suitable for going from a retracted home position to an operating position projecting from the frame, in which the movable contact element interacts with the gripper movement mechanism, and vice versa, to shift the gripper along a guide, an opening mechanism and closing mechanism for the gripper on the guide which are suitable for making the gripper go from a closed position in which the gripper clamps a film to an open position in which the gripper releases the film, and vice versa, wherein the gripper comprises two half-grippers provided with toothed bases engaged with each other, to make the two half-grippers rotate in opposite directions, wherein the closing mechanism for the gripper comprises a cam, suitable for intercepting a pin fixed to at least one of the two half-grippers to make the at least one of the two half-grippers rotate and cause the gripper to close.

10. The device according to claim 9, wherein the opening mechanism for the gripper comprises a further cam, suitable for intercepting the pin to make the at least one of the two half-grippers rotate and cause the gripper to open.

11. The device according to claim 9, and further comprising a film cutting mechanism.

12. The device according to claim 11, wherein the film cutting mechanism comprises a blade fixed to a half-gripper of the gripper.

* * * * *